US005975285A

United States Patent [19]

Krantz

[11] Patent Number: 5,975,285

[45] Date of Patent: Nov. 2, 1999

[54] PORTABLE BASKET FOR DRINKING CONTAINERS OR BOTTLES

[76] Inventor: Sven Olov Krantz, Snögatan 5C, Gävle, Sweden, S-802 76

[21] Appl. No.: 09/180,470

[22] PCT Filed: May 15, 1997

[86] PCT No.: PCT/SE97/00799

§ 371 Date: Nov. 9, 1998

§ 102(e) Date: Nov. 9, 1998

[87] PCT Pub. No.: WO97/44251

PCT Pub. Date: Nov. 27, 1997

[30] Foreign Application Priority Data

May 22, 1996 [SE] Sweden ..... 9601934

[51] Int. Cl.[6] ..... B65D 71/00

[52] U.S. Cl. ..... 206/139; 206/427; 206/549

[58] Field of Search ..... 206/142, 143, 206/162, 203, 139, 145, 427, 541, 542, 547, 549

[56] References Cited

U.S. PATENT DOCUMENTS 407,957 7/1889 Kookogey ..... 206/427 X
4,782,945 11/1988 Geiler et al. ..... 206/139

FOREIGN PATENT DOCUMENTS 1123041 7/1968 United Kingdom .

*Primary Examiner*—Jacob K. Ackun
*Attorney, Agent, or Firm*—Young & Thompson

[57] ABSTRACT

A portable basket for water bottles (1) comprises a body (1) provided with a plurality of compartments (2) for individual bottles (3) in which body a handle device (9') is included. A main piping (9), which is closed at one end and open at the opposite end, is associated with the basket body and with which conduit a plurality of branch conduits (15) communicate, through which water or drinks may be fed out simultaneously from the main piping (9) to a plurality of bottles (3) in the compartments (2).

16 Claims, 2 Drawing Sheets

PORTABLE BASKET FOR DRINKING CONTAINERS OR BOTTLES

TECHNICAL FIELD OF THE INVENTION

This invention relates to a portable basket for drinking containers or bottles, comprising a body provided with a plurality of compartments for individual bottles in which body a handle device is included.

BACKGROUND OF THE INVENTION

Portable baskets of the above-mentioned kind are often used in the sports movement, in particular in connection with team matches, e.g. in football, indoor bandy, handball, basketball, ice-hockey, etc. A responsible person within the team, e.g. the storekeeper thereof, has the duty of supplying each individual player with a bottle filled with drink, most often in the form of fresh water. For the purpose, plastic bottles are usually used which are equipped with a screwable cap on which there is a short tube to which a hose piece is connected which the user may stick into his mouth and suck the water out of the bottle (in practice the water is simultaneously pressed out from the deformable plastic bottle). Refilling a plurality of such bottles is a time-consuming and troublesome business in that the bottles have to be handled individually, more precisely in the following way: In a first step, the bottle is taken up from the basket, the cap being screwed off from the bottle-neck. In case stale water is left in the bottle, it has to be emptied and rinsed. Not until then, new, fresh water may be refilled by connecting the neck of the bottle to a water tap. When the bottle is filled, the cap is screwed on again, and thereafter the bottle is again put down into the basket. Then this procedure has to be repeated for all bottles, the number of which in practice often amounts to 8–10 or more.

OBJECTS AND FEATURES OF THE INVENTION

The present invention aims at obviating difficulties in connection with the refill of fresh water in bottles, more precisely by creating an improved carrier-basket for the bottles. Thus, a primary object of the invention is to create a basket in which the bottles may remain during refilling and which enables refilling without need to handle the separate bottles individually. A further object of the invention is to create a basket which is constructionally simple and cheap to produce.

According to the invention, at least the primary object is attained by the features defined in the characterizing clause of claim 1. Preferred embodiments of the invention are furthermore defined in the dependent claims.

BRIEF DESCRIPTION OF THE APPENDED DRAWINGS

In the drawings:

FIG. 1 is a perspective view of a basket according to the invention made with eight compartments for as many plastic bottles, FIG. 2 is a partly cut long side view of the basket according to FIG. 1, FIG. 3 is an end view of the same basket, FIG. 4 is a planar view from below of the basket, FIG. 5 is a partly cut side view showing a special cap for the plastic bottles in question, the cap being shown in a first state of function, FIG. 6 is an analogous view showing the same cap in a second state of function.

DETAILED DESCRIPTION OF A PREFERRED EMBODIMENT OF THE INVENTION

Figure 1:
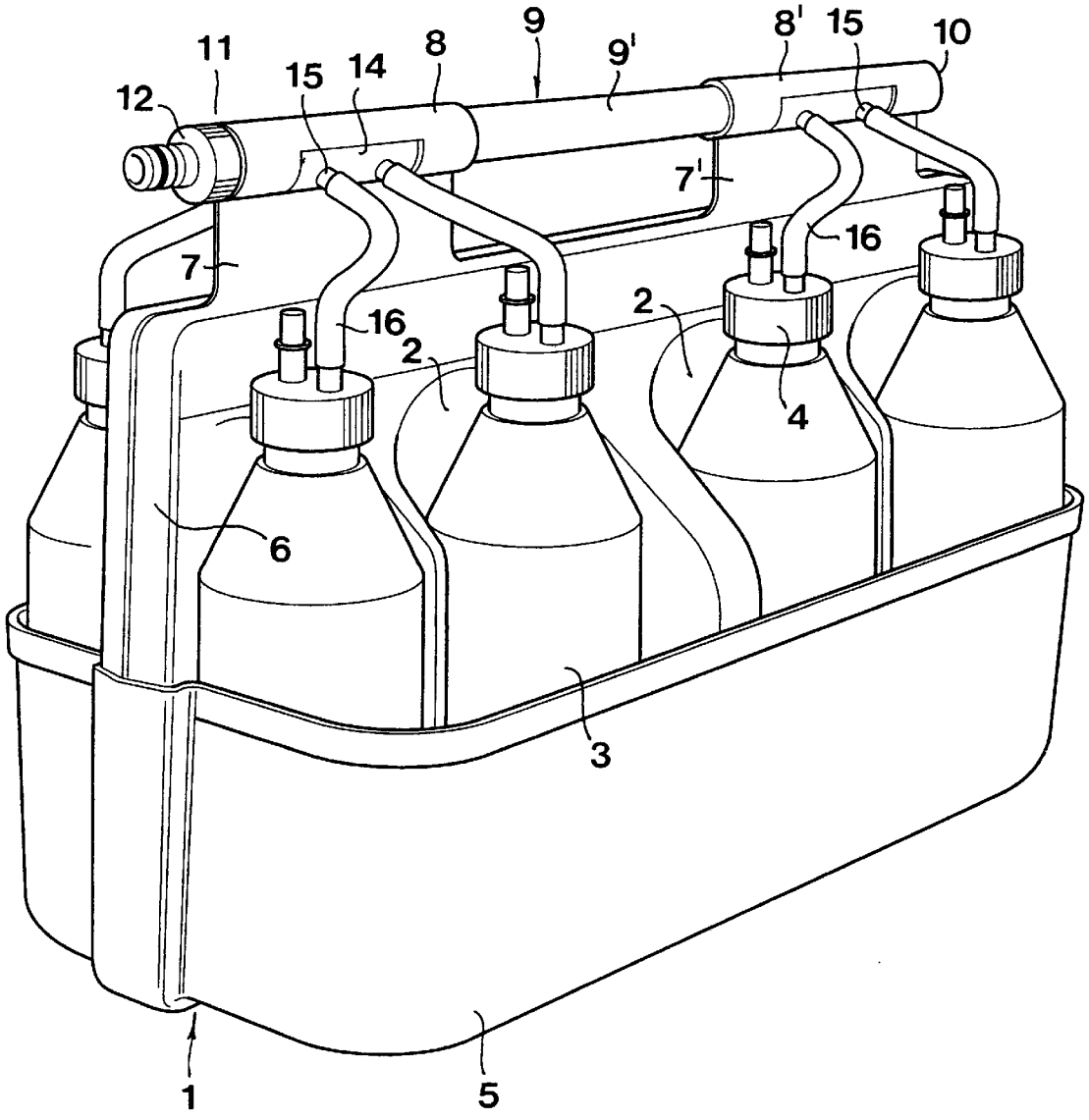
Figure 2:
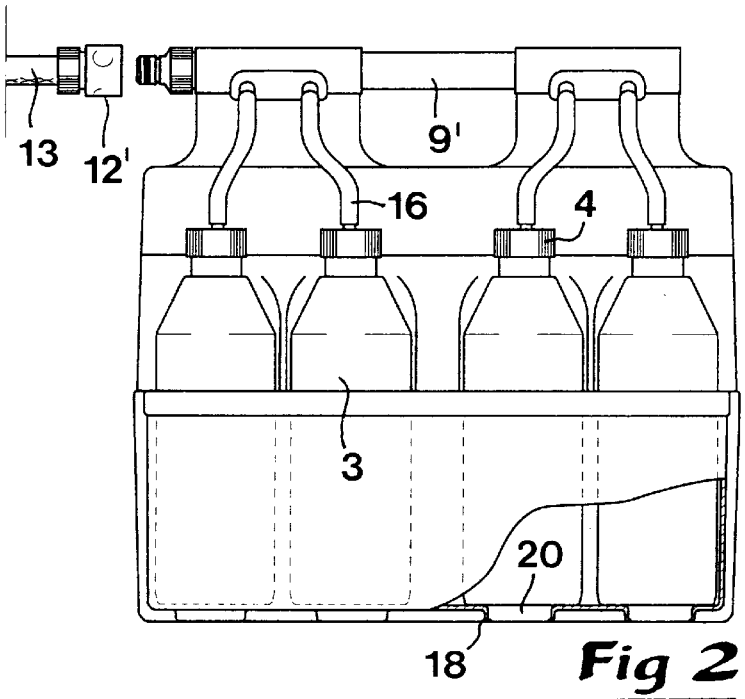

The basket shown in FIG. 1 comprises a body in its entirety designated 1 which in practice may be made of stiff plastic. Compartments 2 are provided in the body for conventional plastic bottles 3 which are equipped with caps 4. In the given example, the basket body includes eight compartments for as many plastic bottles. The body 1 includes a lower tray-like part 5 and a central, protruding wall part 6 which, along the upper edge thereof, has two mutually separated board parts 7, 7', which have cages or sleeves 8, 8' at the top thereof. A tube 9 serving as a main conduit which is closed at the rear end 10 thereof and open at the front end 11 thereof, is mounted in these cages. More precisely, the tube 9 has, at said open end 11, a first quick coupling member 12 arranged to be connected to a second quick coupling member 12' of a hose 13 (see FIG. 2). The central portion 9' of the tube which extends between the two separated cages 8, 8' forms a handle device by means of which the basket may be carried.

Figure 3:
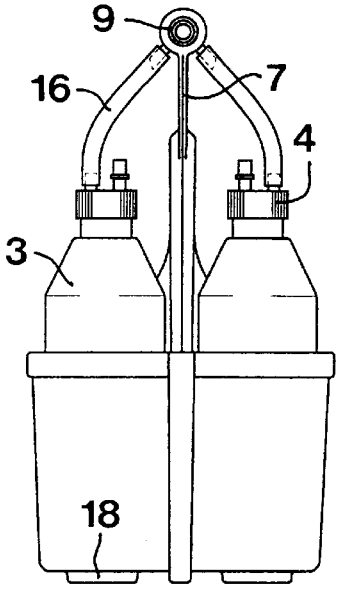
Figure 4:
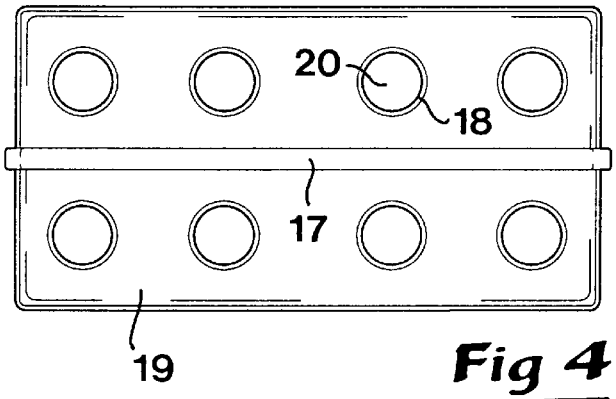

In the shown example, openings 14 which uncover portions of the tube are recessed in the cages 8, 8'. Small tube sockets 15, which form branch conduits communicating with the interior of the main conduit tube 9, are fixed in said openings. An end of a hose 16 may be connected to each such tube socket 15, the opposite end of which hose is permanently connected to the cap 4 of the individual bottle. The number of tube sockets corresponds to the number of compartments 2 in the basket body. In this connection, it may also be mentioned that the main conduit tube 9 as well as the tube sockets 15 in practice suitably are made of stiff plastic as well as the basket body as a whole. As may be seen in FIGS. 2 to 4, the basket body has, at the bottom side thereof, a central longitudinal bead 17 as well as a number of rings 18, corresponding to the number of compartments, which rings protrude from the bottom plate 19 of the basket body, more precisely in connection with holes 20. The rings 18 have mainly the same height as the central bead 17, whereby it is guaranteed that the basket stands steadily on a plane surface. Water in the bottom of the basket may be drained out through the holes 20.

Figure 5:
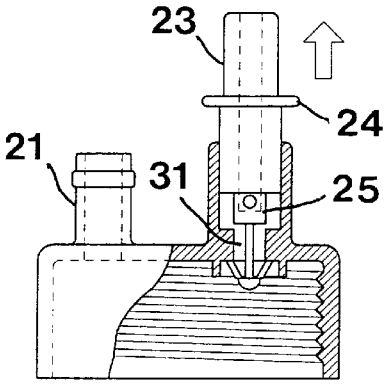
Figure 6:
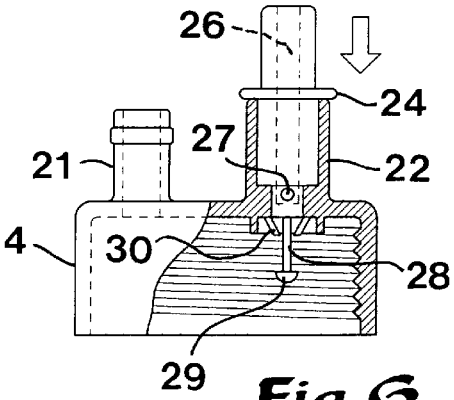

The cap 4 shown in FIG. 5 and 6 is specially designed for co-operation with the basket according to the invention. Apart from a completely open first tube piece 21, said cap includes a second tube piece 22 in which a tenon-formed regulating element 23 is arranged. A collar 24 is arranged approximately in the middle of said tenon element, and, on the bottom side of the element, there is a cylinder-shaped projection 25 having a smaller diameter than the tenon element. A central channel 26 in the tenon element runs into a transverse hole 27 in the projection 25. A slender shaft 28 having a head 29 extends from the projection 25. Said head co-operates with a number of radially separated plastic lugs 30 located in the vicinity of a bore 31 in the plane upper part of the cap.

In FIG. 5, the element 23 is shown in an upper end position in which the head 29 is stopped by the lugs 30. In this position, de-airing of the bottle may be effected, more precisely by the fact that air passes the lugs 30 and through the bore 31 and further via the transverse hole 27 and out through the central channel 26. In FIG. 6, the element 23 is pressed into tube piece 22, the projection 25 being urged into the bore 31. In this way, the bore 31 is closed so that neither air nor water can pass therethrough.

The Function and Advantages of the Basket According to the Invention

When the bottles in a basket are to be filled with water, the basket is put down, e.g. in a sink or on a floor in connection to a tap water tap, and then the hose 13 is connected to the tap as well as to the main conduit tube 9 of the basket, more precisely via the quick coupling 12, 12'. The hoses 16 are connected to the various tube sockets of the main conduit tube, and the caps 4 are adjusted into the de-airing position according to FIG. 5. Hereafter, fresh water is led to the various bottles from the tap water tap via the main conduit tube add the hoses connected to the tube sockets or branch conduits 15. During initial refill of the individual bottle, merely air will first pass through the regulating element 23, but after the bottle has been filled, also water may pass out through the same. In practice, this possibility is essential inasmuch as it is preferred to let water flush through the various bottles during a longer period of time. In this way, it is guaranteed that possibly remaining drops of stale water is flushed out of the bottles. This is something which in turn means that the responsible person is not forced to unscrew the caps and empty the stale water before the refill of new fresh water is started. After the bottles have been flushed through with water during a time of e.g. 5–10 minutes, the water supply is interrupted by shutting the tap, and the basket is separated from the hose 13 by separating the quick coupling members 12, 12'. Water which has flowed up through the cap and down into the lower tray part 5 of the basket is continuously evacuated through the holes 20 in the bottom 19 of the tray part. After all surplus water on the whole in this way has run out through the holes, the basket may be lifted up and then carried out to the match arena in a simple way. In conclusion the hoses 16 are separated from the branch conduits 15, and thereafter the regulating elements 23 are pushed in to a closed position. In this state, the individual water consumer may use the bottle in a conventional way, i.e. bring the hose 16 to the mouth and, if so is desired, press out water by deforming the bottle.

The advantages of the invention are obvious. By the fact that all bottles may be filled with water at the same time without the need of neither removing nor putting on the caps in connections with the refilling, the responsible person's work is limited to connecting a hose to the basket and a tap water tap respectively as well as removing the hose from the basket when a refill has taken place. In other words, the time-consuming and troublesome business of filling the bottles one by one is eliminated.

Feasible Modifications of the Invention

The invention is not limited solely to the embodiment described and shown in the drawings. Although it is preferred to use the intermediate portion of the main conduit tube as a handle device, it is thus feasible to arrange a separate handle device and integrate the piping in the body in another way than the one shown in the drawings. Of course, the number of compartments in the basket body may vary most considerably, although 8–12 (distributed among 4–6 on each side of the central wall part) is preferred in practice.

I claim:

1. A portable basket for drinking containers or bottles, comprising a body (1) provided with a plurality of compartments (2) for individual bottles (3) in which body a handle device is included, characterized in that a main conduit (9), which is closed at one end and open at the opposite end, is associated with the basket body (1) and with which conduit a plurality of branch conduits (15) communicate, through which drink, e.g. water, may be fed out simultaneously from the main conduit (9) to a plurality of bottles (3) in the compartments (2).

2. Basket according to claim 1, characterized in that the number of branch conduits (15) corresponds to the number of compartments (2) in the body (1).

3. Basket according to claim 1, characterized in that a first quick coupling member (12) for connection to a second quick coupling member (12') on a hose or similar is arranged at the open end (11) of the main conduit (9).

4. Basket according to claim 1, characterized in that the main conduit is in the form of a tube (9) which is built-in into the body (1).

5. Basket according to claim 4, characterized in that a portion (9') of the piping (9) extends freely supported between two separated parts (8, 8') of the body so as to serve as a handle device.

6. Basket according to claim 5, characterized in that thy body, in a way known per se, includes a central wall portion (6) which separates two sets of compartments and which at the top has two axially separated board parts (7, 7') on which cages (8, 8') are formed in which the piping (9) is inserted.

7. Basket according to claim 2, characterized in that a first quick coupling member (12) for connection to a second quick coupling member (12') on a hose or similar is arranged at the open end (11) of the main conduit (9).

8. Basket according to claim 2, characterized in that the main conduit is in the form of a tube (9) which is built-in into the body (1).

9. Basket according to claim 3, characterized in that the main conduit is in the form of a tube (9) which is built-in into the body (1).

10. Basket according to claim 7, characterized in that the main conduit is in the form of a tube (9) which is built-in into the body (1).

11. Basket according to claim 8, characterized in that a portion (9') of the piping (9) extends freely supported between two separated parts (8, 8') of the body so as to serve as a handle device.

12. Basket according to claim 9, characterized in that a portion (9') of the piping (9) extends freely supported between two separated parts (8, 8') of the body so as to serve as a handle device.

13. Basket according to claim 10, characterized in that a portion (9') of the piping (9) extends freely supported between two separated parts (8, 8') of the body so is to serve as a handle device.

14. Basket according to claim 11, characterized in that the body, in a way known per se, includes a central wall portion (6) which separates two sets of compartments and which at the top has two axially separated board parts (7, 7') on which cages (8, 8') are formed in which the piping (9) is inserted.

15. Basket according to claim 12, characterized in that the body, in a way known per se, includes a central wall portion (6) which separates two sets of compartments and which at the top has two axially separated board parts (7, 7') on which cages (8, 8') are formed in which the piping (9) is inserted.

16. Basket according to claim 13, characterized in that the body, in a way known per se, includes a central wall portion (6) which separates two sets of compartments and which at the top has two axially separated board parts (7, 7') on which cages (8, 8') are formed in which the piping (9) is inserted.

* * * * *